US006305816B1

(12) United States Patent
Corcorran et al.

(10) Patent No.: US 6,305,816 B1
(45) **Date of Patent: *Oct. 23, 2001**

(54) ON-SITE FABRICATED LINEAR AMBIENT LIGHTING SYSTEM

(75) Inventors: Sean M. Corcorran, Palo Alto, CA (US); Angela R. M. Nahikian, Ada, MI (US); David M. Webster, San Mateo, CA (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/267,314

(22) Filed: Mar. 12, 1999

(51) Int. Cl.[7] ..... F21S 8/06
(52) U.S. Cl. ..... 362/147; 362/219; 362/225
(58) Field of Search ..... 362/225, 219, 362/217, 260, 223, 147, 145; 52/745.19, 745.2

(56) References Cited

U.S. PATENT DOCUMENTS

| | | | | |
|---|---|---|---|---|
| D. 307,639 | | 5/1990 | Lettenmayer . | |
| D. 352,566 | | 11/1994 | Johnson et al. . | |
| 2,259,151 | | 10/1941 | Claspy . | |
| 2,465,141 | * | 3/1949 | Wakefield | 362/219 |
| 2,493,415 | | 1/1950 | Navin . | |
| 2,525,315 | | 10/1950 | Schepmoes . | |
| 2,932,728 | | 4/1960 | Thomas . | |
| 2,988,633 | * | 6/1961 | Rosenfield | 362/219 |
| 2,990,470 | * | 6/1961 | Bodian et al. | 362/219 |
| 3,375,322 | * | 3/1968 | Serio et al. | 362/219 |
| 3,409,262 | * | 11/1968 | Soule | 362/225 |
| 3,529,461 | | 9/1970 | Knudson . | |
| 4,580,200 | | 4/1986 | Hess et al. . | |
| 4,655,858 | | 4/1987 | Addison . | |
| 4,712,165 | | 12/1987 | Cetrone . | |
| 4,748,547 | | 5/1988 | Baker . | |
| 4,858,087 | | 8/1989 | Hartshorn . | |
| 4,866,584 | | 9/1989 | Plewman . | |
| 4,899,566 | | 2/1990 | Kundson . | |
| 4,939,627 | | 7/1990 | Herst et al. . | |
| 5,111,370 | | 5/1992 | Clark . | |
| 5,186,537 | | 2/1993 | Katoh et al. . | |
| 5,371,661 | * | 12/1994 | Simpson | 362/219 |
| 5,394,722 | | 3/1995 | Meyer . | |
| 5,551,272 | | 9/1996 | Knudson . | |
| 5,658,066 | | 8/1997 | Hirsch . | |
| 5,709,460 | | 1/1998 | Lester . | |
| 5,740,687 | | 4/1998 | Meyer et al. . | |
| 5,823,656 | | 10/1998 | Waldmann . | |
| 5,865,528 | | 2/1999 | Compton et al. . | |
| 5,884,994 | | 3/1999 | Herst et al. . | |

* cited by examiner

*Primary Examiner*—Thomas M. Sember
(74) *Attorney, Agent, or Firm*—Price, Heneveld, Cooper, DeWitt & Litton

(57) ABSTRACT

A linear ambient lighting system is adapted for on-site fabrication in open building plans and the like. The lighting system includes a plurality of elongated lighting elements having electrical power sockets at the opposite ends thereof to physically support the lighting elements and electrically connect the same with electrical connectors to supply electrical power to the lighting elements. Suspended fixture supports are connected with and support the electrical power sockets and are configured to be spaced longitudinally along the length of the associated lighting fixture. Hangers are provided with first ends connected with an overhead support portion of an associated building, and second ends connected with and supporting the fixture supports. An elongated housing having an uninterrupted one-piece construction is formed on-site from strip stock to a selected length that extends continuously along the entire length of the associated lighting fixture. Connectors attach the housing to each of the fixture supports to laterally interconnect the same and define a rigid lightweight assembly that has a neat, custom one-piece appearance and can be fabricated on-site at the associated building to alleviate transportation damage and cost.

33 Claims, 6 Drawing Sheets

ON-SITE FABRICATED LINEAR AMBIENT LIGHTING SYSTEM

BACKGROUND OF THE INVENTION

The present invention relates to ambient lighting systems and the like, and in particular to an on-site fabricated linear lighting system.

Linear ambient lighting systems are used in a wide variety of building construction applications. The linear lights or fixtures typically include a housing, an elongated lighting element, and some kind of supporting structure for suspending the lighting system from the ceiling of an associated building.

Heretofore, linear lighting systems have normally incorporated multiple separate lighting units or fixtures that are positioned end-to-end to form a single elongate linear light. These lighting units are suspended from the ceiling and may be fastened together end-to-end. Such lighting units are normally prefabricated before reaching the construction site. More specifically, the lighting units are preassembled at their place of manufacture, such that the lighting units are complete with a housing and other associated components prior to shipping. This method of construction and application typically results in a large number of light fixtures being damaged during shipping. In addition, the use of multiple lighting units to form a single linear light affords an inefficient installation process and an unattractive overall appearance, since the light has a distinctive segmented look, instead of the desired one-piece custom appearance. The appearance of such lighting is quite important when the building space is being used for offices, meeting rooms, and the like. The increased popularity of open office plans has created a need for attractive linear lighting systems that can be manufactured and installed quickly and economically.

While some types of linear ambient lighting systems use prefabricated elongated assemblies which are ready to hang as a unit, such products are generally by nature very long, and therefore fragile and expensive to ship long distances. In addition, lighting fixtures much beyond 8 feet in length are difficult, if not impossible, to transport into existing buildings without first removing windows. While cranes are often employed in high rise constructions to lift linear lighting equipment through upper floor window openings, such installation processes increase cost, time, and potential fixture damage.

SUMMARY OF THE INVENTION

One aspect of the present invention is to provide a linear ambient lighting system adapted for on-site fabrication in open building plans and the like. The lighting system includes a plurality of elongated lighting elements having electrical power sockets at the opposite ends thereof to physically support the lighting elements and electrically connect the same with electrical connectors to supply electrical power to the lighting elements. Suspended fixture supports are connected with and support the electrical power sockets and are configured to be spaced longitudinally along the length of the associated lighting fixture. Hangers are provided with first ends connected with an overhead support portion of an associated building, and second ends connected with and supporting the fixture supports. An elongated housing having an uninterrupted one-piece construction is formed on-site from strip stock to a selected length that extends continuously along the entire length of an associated lighting fixture. Connectors attach the housing to each of the fixture supports to laterally interconnect the same and define a rigid lightweight assembly that has a neat, custom one-piece appearance and can be fabricated on-site at the associated building to alleviate transportation damage and cost.

Another aspect of the present invention is to provide a method for making linear ambient lighting on-site for open building plans and the like. The method includes providing a plurality of elongated lighting elements that have electrical connectors positioned adjacent to the opposite ends thereof, providing a plurality of electrical power sockets that are shaped to receive the opposite ends of the lighting elements therein to physically support the same and connect with the electrical connectors to supply electrical power to the lighting elements, providing a plurality of fixture supports shaped for connection with the electrical power sockets and configured to be spaced longitudinally along the length of an associated lighting fixture, and providing a plurality of hangers. The method further includes connecting the first ends of the hangers to an overhead portion of an associated building in a mutually linear relationship, mounting the fixture supports on the second ends of the hangers, assembling the electrical power sockets on the opposite ends of the lighting elements to define lighting assemblies, positioning the light assemblies between laterally adjacent pairs of the fixture supports and connecting the same thereto, forming on-site at the associated building at least one elongated housing to a selected length that extends continuously along an entire length of the lighting fixture, and connecting the housing to each of the fixture supports to laterally interconnect the same and define a rigid lightweight assembly that has a neat, custom one-piece appearance and can be fabricated on-site at the associated building to alleviate transportation damage and cost.

Yet another aspect of the present invention is to provide a linear ambient lighting system kit. The lighting kit includes a plurality of elongated lighting elements having electrical power sockets at the opposite ends thereof to physically support the lighting elements and electrically connect the same with the electrical connectors to supply electrical power to the lighting elements. Suspended fixture supports are connected with and support the electrical power sockets and are adapted to be spaced longitudinally along the length of the associated lighting fixture. Hangers are provided with first ends connected with an overhead support portion of an associated building, and second ends connected with and supporting the fixture supports. An elongated housing having an uninterrupted one-piece construction is formed on-site from strip stock to a selected length that extends continuously along the entire length of the associated lighting fixture. Connectors attach the housing to each of the fixture supports to laterally interconnect the same and define a rigid lightweight assembly that has a neat, custom one-piece appearance and can be fabricated on-site at the associated building to alleviate transportation damage and cost.

The principle objects of the present invention are to provide a linear ambient lighting system adapted for on-site fabrication in open building plans and the like. The utilization of a housing having an uninterrupted one-piece construction formed on-site provides a lighting system with a neat, custom one-piece appearance aiding in the aesthetics of the application. In addition, on-site fabrication and assembly of the lighting system reduces costs associated with transportation and damage normally associated with shipping and installing prefabricated light assemblies. The lighting system has an uncomplicated, lightweight construction that reduces manufacturing, fabrication and installation costs and difficulty.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
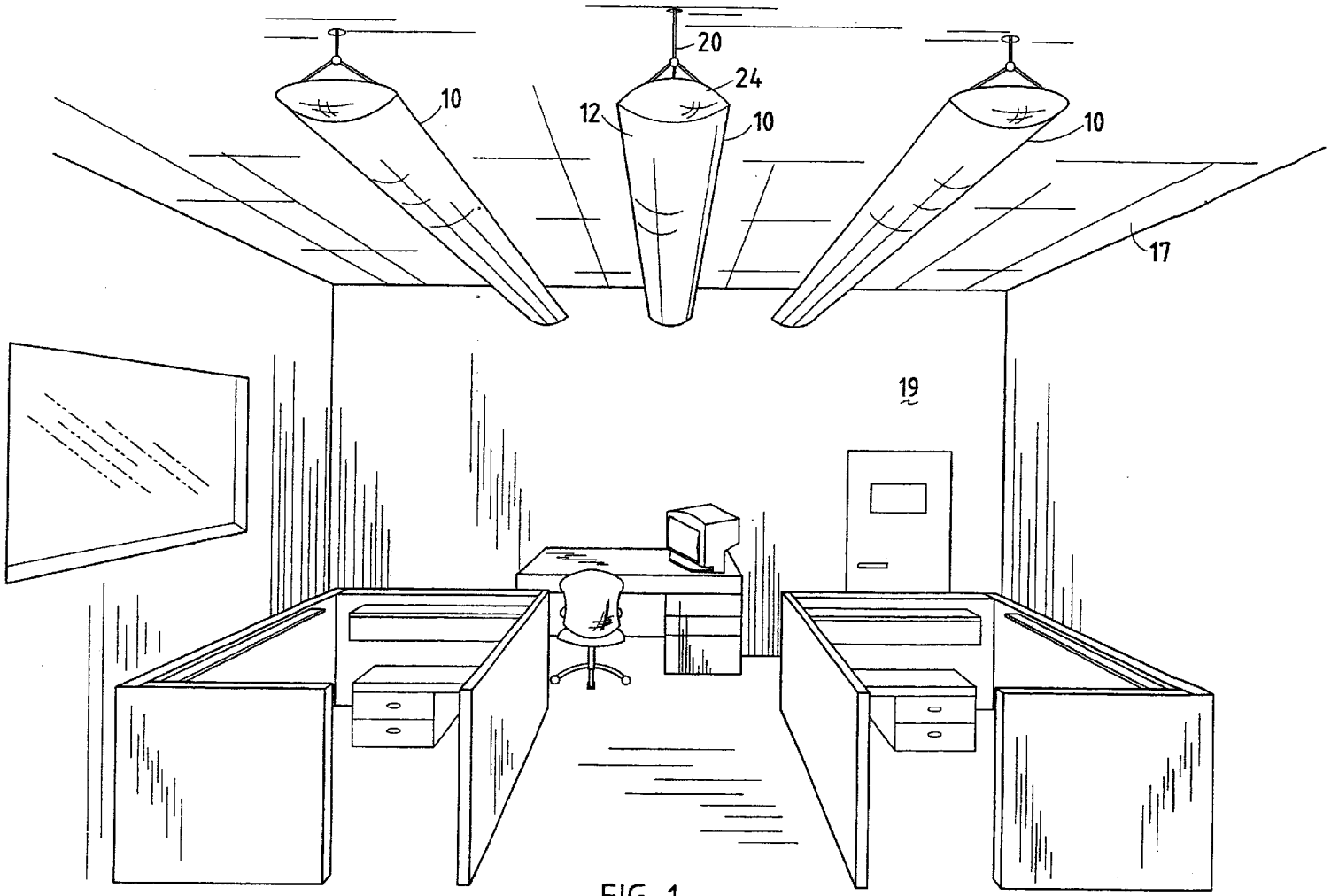
FIG. 1 is a perspective view of three linear ambient lighting systems embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIGS. 1 and 2) generally designates a linear ambient lighting system embodying the present invention. In the illustrated example, the lighting system 10 includes a plurality of elongated lighting elements 14 having electrical power sockets 16 located at the opposite ends thereof to physically support the lighting elements 14 and electrically connect the same with a series of electrical connectors 15 that supply electrical power to the lighting elements 14. A plurality of suspended fixture supports 18 are connected with and support the electrical power sockets 16, and are configured to be spaced longitudinally along the length of the associated lighting system 10. A plurality of hangers 20 are provided with first ends 62 connected with an overhead support portion 17 of an associated building 19, and second ends 64 that connect with and support fixture supports 18. An elongated housing 12 has an uninterrupted one-piece construction and is formed on-site from strip stock to a selected length that extends continuously along the entire length of an associated lighting system 10. A plurality of connectors attach the housing 12 to each of the fixture supports 18 to laterally interconnect the same and define a rigid lightweight assembly that has a neat, custom one-piece appearance and can be fabricated on-site at the associated building to alleviate transportation damage and cost.

In the illustrated example, lighting elements 14 are fluorescent, elongated tube-style bulbs, such as those normally used in indirect linear lighting systems, although it is noted that other types and styles of lighting elements may be substituted. Each lighting element 14 is provided with electrical connectors 15 on the opposite ends thereof and of a type normally associated with fluorescent lighting tubes.

The illustrated power sockets 16 are provided with a ballast section 40 and an upper section 41. The ballast section 40 is defined by an arcuately shaped downwardly facing surface 42, a generally flat end surface 44, and a support surface 47. The upper section 41 is defined by the end surface 44, a connection surface 43, and an arcuately shaped top surface 45 extending therebetween. The connection surface 43 of each power socket 16 is provided with electrical connectors 13 that are configured to electrically connect with the electrical connectors 15 of the lighting elements 14. Support surfaces 47 of power sockets 16 are shaped to physically support lighting elements 14 thereon.

Figure 2:
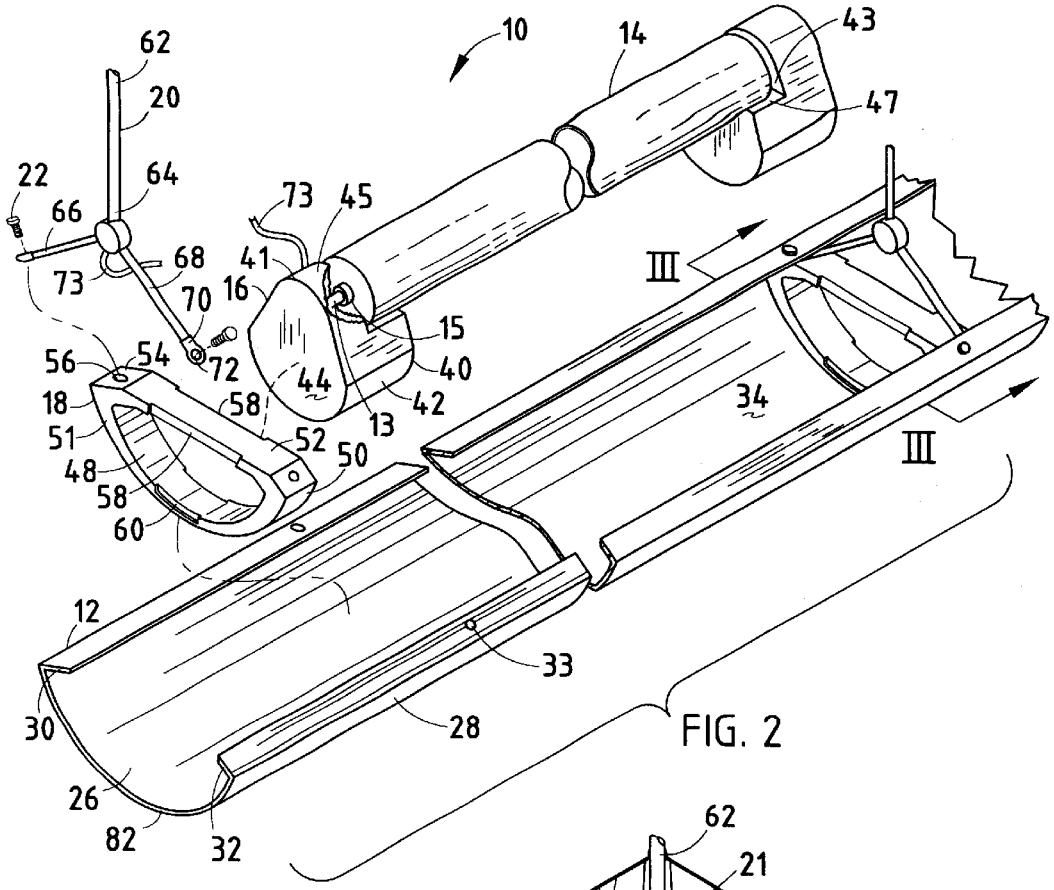
FIG. 2 is an exploded perspective view of the linear ambient lighting system.
Figure 3:
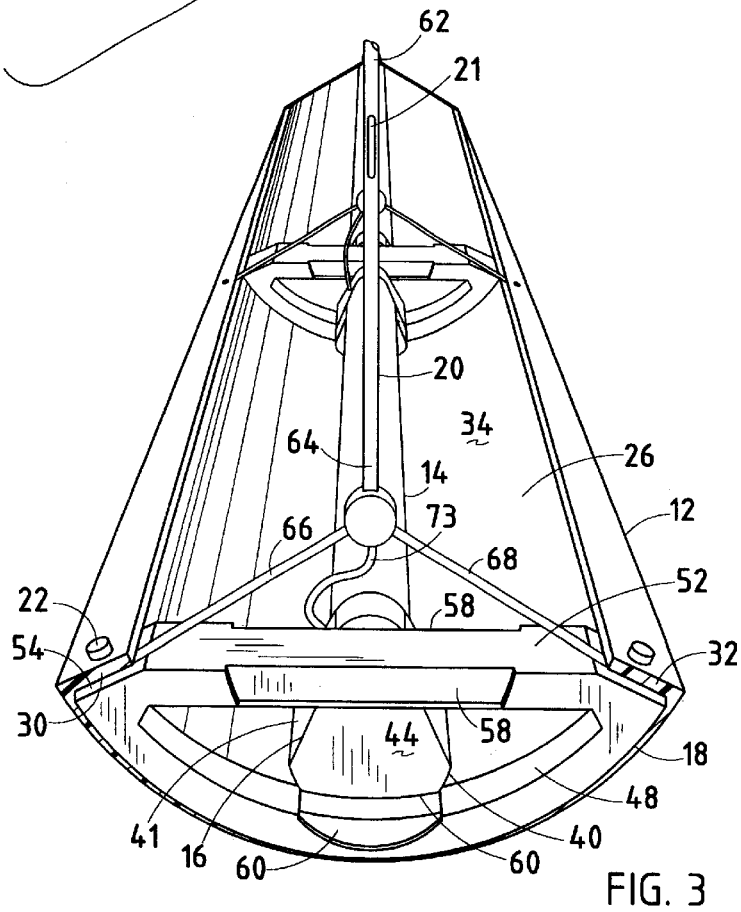
FIG. 3 is a cross-sectional perspective view of the lighting system, taken along line III—III, FIG. 2.
Figure 4:
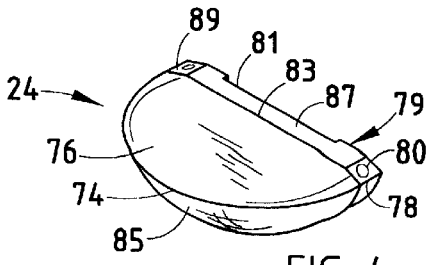
FIG. 4 is a perspective view of an end cap.
Figure 5:
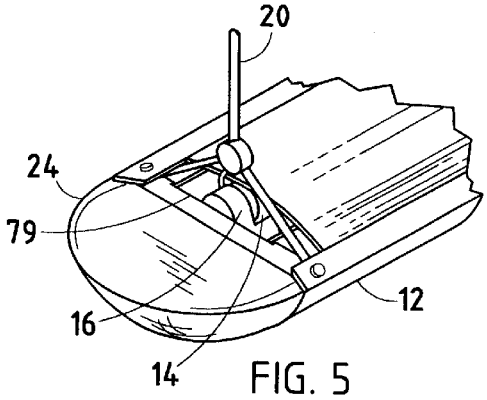
FIG. 5 is a fragmentary perspective view of the end cap assembled with the lighting system.
Figure 7:
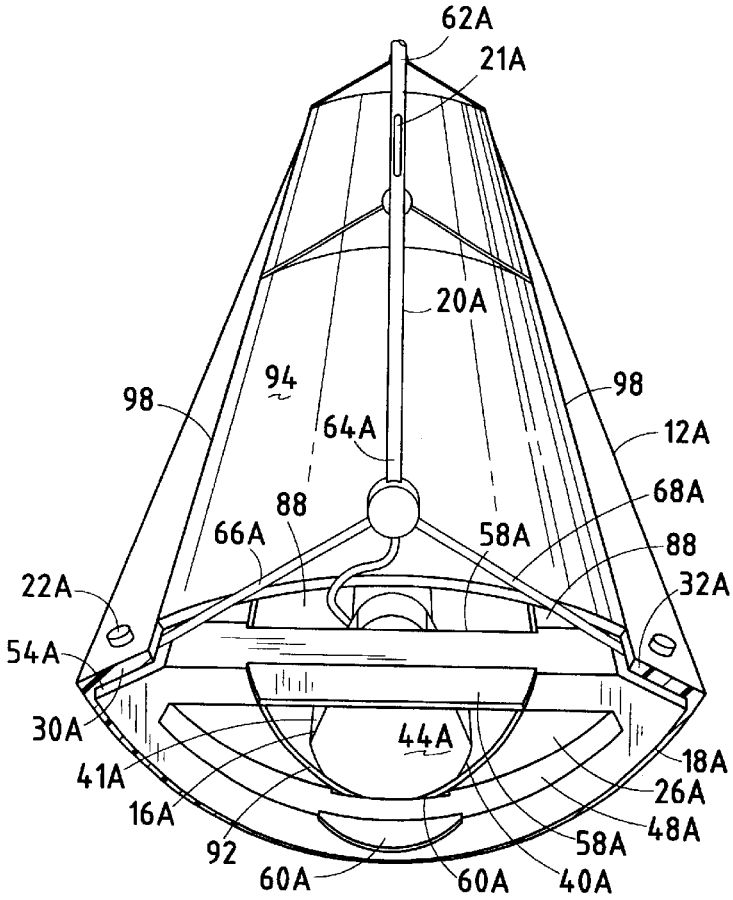
FIG. 7 is a cross-sectional perspective view of the first alternate embodiment of the lighting system, taken along line VII—VII, FIG. 6.

The fixture supports 18 shown in FIGS. 2 and 3 have a generally ring-shaped side-elevational shape with an open center 48. Each fixture support 18 is defined by an arcuately shaped, downwardly facing marginal surface 50, a top surface 52, side surfaces 51, and generally flat, horizontally oriented, upwardly facing marginal surfaces 54, each having a threaded aperture 56 centrally located therein. The side surfaces 51 of each fixture support 18 are further provided with inwardly extending, arcuately shaped upper notches 58 and inwardly extending, arcuately shaped lower notches 60.

In the example illustrated in FIGS. 1–5, hangers 20 are each provided with first end 62 that is connected with the overhead support portion 17 of the associated building 19 and second end 64 that flares into a first connector half 66 and a second connector half 68. The first connector half 66 and the second connector half 68 of each hanger 20 are provided with an eyelet 70 having a centrally located aperture 72 therein. Each hanger 20 has a hollow interior 21 in which electrical conductors, such as wires 73, are routed so as to provide electrical power from an electrical source (not shown) to the electrical power sockets 16.

Connectors 22 are mechanical fasteners, such as the illustrated machine screws, although it is noted that other forms of fasteners may be used including, but not limited to, bolts and nuts, rivets, and spring clips.

The illustrated housing 12 (FIGS. 1–3) has an uninterrupted one-piece construction formed of sheet metal, although it is noted that it can also be made from any suitable lightweight material, such as plastics or composites. Housing 12 is defined by an upper surface 26 and a lower surface 28 and has a generally upwardly curved trough shape and an arcuate lateral cross-sectional shape. Housing 12 is provided with a first inwardly turned side edge 30 and a second inwardly turned side edge 32. Edges 30 and 32 are laterally spaced apart to define therebetween an upwardly opening window 34. First edge 30 and second edge 32 of housing 12 are provided with a plurality of paired, juxtaposed apertures 33. The upper surface 26 of housing 12 is naturally light reflective, although it is noted that upper surface 26 can be coated with a light reflective substance. In addition, the upper surface 26 of housing 12 can be provided with a reflective material that is formed with or co-extruded with housing 12. This co-extruded material is discussed in greater detail within the description of the third embodiment.

Housing 12 is preferably formed using commonly known roll forming techniques for shaping continuous extrusions of sheet metal and is formed on the construction site itself, preferably by a portable type of roll forming machine. Using the roll forming techniques, the housing 12 would normally be formed from a coiled strip of sheet metal (not shown), although it is noted that other suitable materials may be used. Housing 12 can be formed to any selected length, including a length that extends continuously along the entire length of the lighting system 10.

Lighting system 10 is further provided with end caps 24 (FIGS. 4 and 5) having a hollow, arcuately shaped body that includes an arcuate end 74 and a notched end 78. Arcuate end 74 has a downwardly facing arcuate surface 85 and a substantially flat top surface 76. Notched end 78 has a substantially flat end surface 79, a top surface 87, and upwardly facing marginal surfaces 89. Arcuate surface 85 of each end cap 24 is provided with a finished surface that adds to the overall aesthetic appeal of the lighting system 10. Notched end 78 of each end cap 24 is provided with a step 83 extending about the circumference of end cap 24 and configured, such that end cap 24 can be mateably received within an end 82 (FIGS. 2 and 5) of housing 12. The end surface 79 of each end cap 24 is provided with an arcuately shaped notch 81. Marginal surfaces 89 of each end cap 24 are provided with centrally located threaded apertures 80.

In formation and assembly, the housing 12 can be formed to fit any length application desired. After determining the length of the desired light fixture by considering factors such as the length of the room, the spacing of any overhead support structures 17, and the length of the lighting elements 14, the housing 12 is formed on-site using any method of roll forming known in the art. This on-site fabrication of the housing allows customized fitting of the lighting system 10 to the particular application, thus resulting in a lighting system 10 having a clean, single-unit appearance. This is more suitable for certain applications, such as office settings having an open floor plan. This roll forming step can also include the formation of any necessary details in the housing 12, such as the formation of the apertures 33 with edges 30 and 32 of housing 12.

After formation of the housing 12, the fixture supports 18 (FIGS. 2, 3, and 5) are seated within the housing 12, such that the arcuate surface 50 of the fixture support 18 is in substantial contact with the upper surface 26 of housing 12, and surfaces 54 of each fixture support 18 are in substantial contact with edges 30 and 32 of housing 12. Fixture supports 18 are positioned within the housing 12, such that the threaded apertures 56 located within surfaces 54 of each fixture support 18 are in coaxial alignment with the apertures 33 within edges 30 and 32 of housing 12. Power sockets 16 are electrically connected with the electrical connectors 15 of each lighting element 14. The power sockets 16 are seated within the fixture supports 18, such that arcuate surface 42 of ballast section 40 of each power socket 16 rests within lower notch 60 of each fixture support 18, and end surface 44 of each power socket 16 rests within upper notch 58 of each fixture support 18, thereby restricting movement of the lighting element 14 and associated power sockets 16 within housing 12. Electrical wires 73 are in electrical communication with power sockets 16. Eyelets 70 of hangers 20 are positioned between edges 30 and 32 of housing 12 and surfaces 54 of each fixture support 18. Eyelets 70 are held in position by connectors 22 that are engaged through apertures 33 of housing 12 and eyelets 70 of hangers 20 and threadably engaged within apertures 56 of fixture supports 18. Hangers 20 are connected to end caps 24 in a manner similar to the connection of hangers 20 to fixture supports 18.

After assembly, the entire lighting system 10 can be raised to the appropriate above ground level and the upper end 62 of each hanger 20 attached to the overhead support portion of the associated building 19. The result is an easy to assemble and install light fixture that is aesthetically compatible with today's building requirements.

In operation, indirect ambient lighting is provided when light emitted from each lighting element 14 is reflected upwardly from the upper surface 26 of housing 12 and outwardly through window 34.

Figure 6:
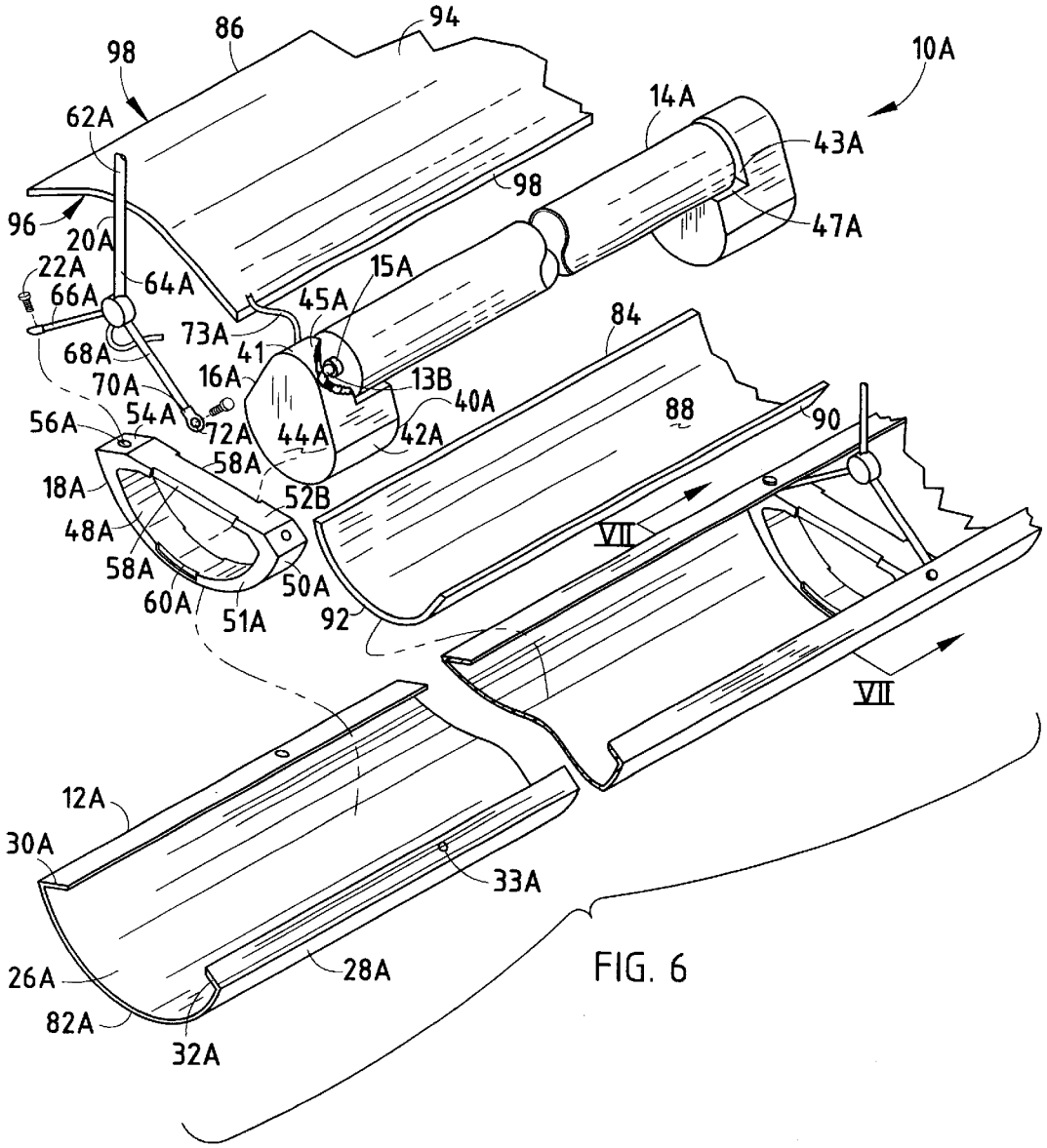
FIG. 6 is an exploded perspective view of a first alternate embodiment of the lighting system.

The reference numeral 10A (FIG. 6) generally designates another embodiment of the present invention. Since the lighting system 10A is similar to the previously described lighting system 10, similar parts appearing in FIGS. 2 and 3, and FIGS. 6 and 7, respectively, are represented by the same corresponding reference numeral, except for the suffix "A" in the numerals of the latter. In lighting system 10A, the lighting system 10 of FIG. 1 further includes an elongated reflector 84 and an elongated lens 86.

Reflector 84 has an upwardly curved trough shape and is defined by a top surface 88, a bottom surface 90, and ends 92. The reflector 84 is constructed of a material that reflects light, although it is noted that top surface 88 of reflector 84 could also be coated with a reflective substance or material.

The lens 86 is provided with a slightly arcuate downwardly curved shape and is defined by a top surface 94, a bottom surface 96, and edges 98. Lens 86 is constructed of a transparent or translucent material, such as plastic or glass.

Lighting system 10A (FIGS. 6 and 7) is formed and assembled similar to the lighting system 10 (FIGS. 2 and 3). After formation of housing 10A, fixture supports 18A are seated within the housing 12A, such that the arcuate surface 50A of the fixture support 18A is in substantial contact with the upper surface 26A of housing 12A, and surfaces 54A of each fixture support 18A are in substantial contact with edges 30A and 32A of housing 12A. Fixture supports 18A are positioned within the housing 12A, such that the threaded apertures 56A located within surfaces 54A of each fixture support 18A are in coaxial alignment with the apertures 33A within edges 30A and 32A of housing 12A. Reflector 84 is seated within the fixture supports 18A, such that reflector 84 rests within lower notch 60A and upper notch 58A of each fixture support 18A. Power sockets 16A are electrically connected with the electrical connectors 15A of each lighting element 14A. The power sockets 16A are seated within reflector 84, such that the arcuate surface 42A of ballast section 40A of each power socket 16A is in substantial contact with top surface 88 of the reflector 84. Lens 86 is seated on top of the lighting system 10A, such that the bottom surface 96 of lens 86 contacts at least a portion of marginal surfaces 54A of each fixture support 18A, and edges 98 of lens 86 contact edges 30A and 32A of housing 12A. Electrical wires 73A are in electrical communication with power sockets 16A. Eyelets 70A of hangers 20A are positioned between edges 30A and 32A of housing 12A and surfaces 54A of each fixture support 18A. Eyelets 70A are held in position by connectors 22A that are engaged through apertures 33A of housing 12A and eyelets 70A of hangers 20A and threadably engaged within apertures 56A of fixture supports 18A.

After assembly, the entire lighting system 10A can be raised to the appropriate above ground level and the upper end 62A of each hanger 20A can be attached to the overhead support portion 17 of the associated building 19 (FIG. 1). The result is an easy to assemble light fixture that is aesthetically compatible with today's building requirements.

The reference numeral 10B (FIGS. 8 and 9) generally designates yet another embodiment of the present invention. Since the lighting system 10B is similar to the previously described lighting system 10, similar parts appearing in FIGS. 2 and 3, and FIGS. 8 and 9, respectively, are represented by the same corresponding reference numeral, except for the suffix "B" in the numerals of the latter.

Lighting system 10B includes a reflector 104 that is constructed of a light reflective material and is contemporaneously formed with and to housing 12B during the roll forming process. Forming reflector 104 with housing 12B during the roll forming process eliminates the necessity of having to assemble a separate reflector with the lighting system 10B or having to adhere the reflector to the housing 12B after the housing 12B has been formed. It is noted that reflector 104 can be applied after housing 12B is formed or that housing 12B can be provided with a light reflective top surface 26B, thus eliminating the need for reflector 104.

Power sockets 16B (FIGS. 8 and 9) are similar in shape to power sockets 16 of lighting system 10. Each power socket 16B is provided with downwardly facing arcuate surfaces 42B having the same arcuate shape as defined by housing 12B. Each power socket 16B is further provided with an aperture 112 centrally located within surface 44B and extending to the electrical connectors 13B associated therewith.

Fixture supports 18B are similar in shape to fixture supports 18 of lighting system 10. Each fixture support 18B is provided with a pair of downwardly extending notches 108 located between top surface 52B and marginal surfaces 54B. Top surface 52B of each fixture support 18B is provided with a centrally located aperture 106 extending between top surface 52B and open center 48B.

Figure 8:
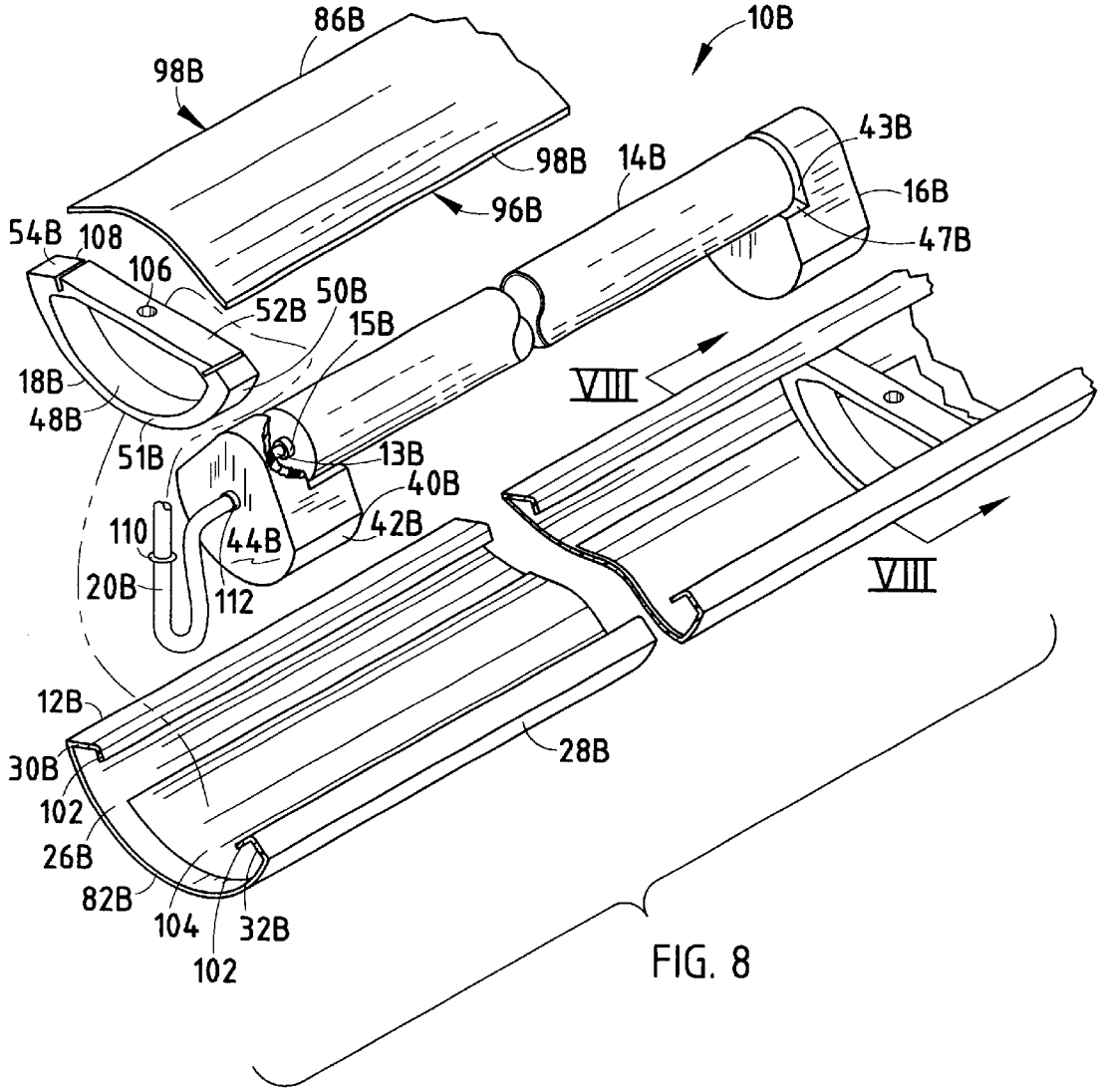
FIG. 8 is an exploded perspective view of a second alternate embodiment of the lighting system.
Figure 9:
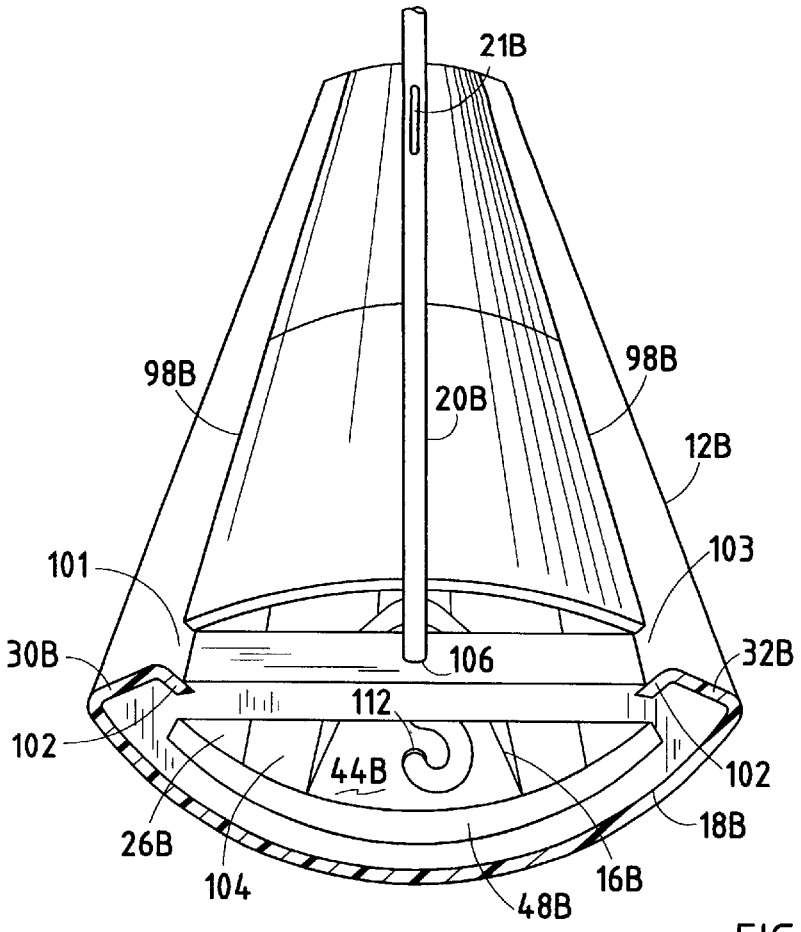
FIG. 9 is a cross-sectional perspective view of the second alternate embodiment of the lighting system, taken along line IX—IX, FIG. 8.
Figure 10:
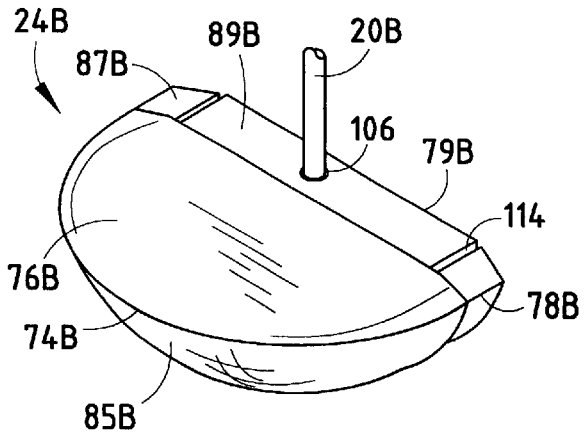
FIG. 10 is a perspective view of an alternate embodiment of the end cap.

In the example illustrated in FIGS. 8–10, hangers 20B are each provided with a first end 62B configured to connect to the overhead portion 17 of the associated building 19 (FIG. 1), a second end 64B configured to mateably attach to power socket 16B within aperture 112, and a stop ring 110 positioned about each hanger 20B. Each hanger 20B has a hollow interior 211B in which electrical conductors, such as wires (not shown), are routed so as to provide electrical power from an electrical source (not shown) to the electrical power sockets 16B, similar to hangers 20 of lighting system 10.

Housing 12B is similar in construction and shape to housing 12 of lighting system 10. Housing 12B is further provided with downwardly turned flanges 102 linearly extending along the length of the edges 30B and 32B.

End caps 24B, as illustrated in FIG. 10, are similar in shape to end caps 24 of lighting system 10. Each end cap 24B is provided with a pair of downwardly extending notches 114 located between top surface 89B and marginal surfaces 87B. Top surface 89B of each end cap 24B is provided with a centrally located aperture 106 extending between top surface 89B and the hollow interior (not shown) of end cap 24B.

Lighting system 10B (FIGS. 8–10) is formed and assembled similar to the lighting system 10 (FIGS. 2 and 3). After formation of housing 12B, the fixture supports 18B are seated within the housing 12B, such that the arcuate surface 50B of each fixture support 18B rests within and is in substantial contact with the upper surface 26B of housing 12B, and surfaces 54B of each fixture support 18B are in substantial contact with edges 30B and 32B of housing 12B. Fixture supports 18B are positioned within the housing 12B, such that flanges 102 of housing 12B extend into and are held within notches 108 of fixture supports 18B thereby holding fixture supports 18B within housing 12B. Power sockets 16B are electrically connected with the electrical connectors 13B of each lighting element 14B. The power sockets 16B associated with ends 36B and 38B of each lighting element 14B are seated within housing 12B, such that arcuate surface 42B of each power socket 16B rests within and is in substantial contact with top surface 26B of housing 12B. Hangers 20B are extended through apertures 106 of fixture supports 18B and attach to fixture supports 18B within aperture 112. Upward movement of each hanger 20B within aperture 112 is restricted by stop ring 110 positioned about hanger 20B within open center 48B of each fixture support 18B, thereby supporting lighting system 10B from the overhead support portion 17 of the associated building 19. Electrical wires (not shown) are located within the interior of hangers 20B and are in electrical communication with power sockets 16B. Hangers 20B are connected to end caps 24B in a manner similar to the connection of hangers 20B to fixture supports 18B.

After assembly, the entire lighting system 10B can be raised to the appropriate above ground level and the first end 62B of each hanger 20B can be attached to the overhead support portion 17 of the associated building 19 (FIG. 1). The result is an easy to assemble light fixture that is aesthetically compatible with today's building requirements.

In operation, indirect ambient lighting is provided when light emitted from each lighting element 14B is reflected upwardly from the reflector 104 associated with the upper surface 26B of housing 12B and outwardly through lens 86B.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A method for making linear ambient lighting on-site for open building plans, comprising:

providing a plurality of elongated lighting elements oriented in and end-to-end relationship and having electrical connectors positioned adjacent opposite ends of each one of the lighting elements;

providing a plurality of electrical power sockets shaped to receive the opposite ends of the lighting elements therein to physically support the lighting elements in the end-to-end relationship and electrically connect with the electrical connector-s to supply electrical power to the lighting elements;

providing a plurality of fixture supports shaped for connection with the electrical power sockets and configured to be spaced longitudinally along a length of an associated lighting fixture, providing a plurality of hangers having first ends and second ends;

connecting the first ends of the hangers to an overhead portion of an associated building in a mutually linear relationship;

mounting the fixture supports on the second ends of the hangers;

assembling the electrical power sockets on the opposite ends of lighting elements to define light assemblies;

positioning the light assemblies between laterally adjacent pairs of the fixture supports and connecting the same thereto;

forming on-site at the associated building a single elongated housing that spans each of the light assemblies in the end-to-end relationship and extends continuously along an entire length of the lighting fixture; and connecting the housing to each of the fixture supports to define a rigid lightweight assembly that has a neat, custom one-piece appearance and is fabricated on-site at the associated building to alleviate transportation damage and cost.

2. A method as set forth in claim 1, wherein:

said housing forming step includes forming the housing from a coil of strip stock.

3. A method as set forth in claim 2, wherein:

said housing forming step comprises roll forming the housing from a coiled strip of sheet metal.

4. A method as set forth in claim 3, including:

forming a reflector on the upper surface of the housing during said housing forming step.

5. A method as set forth in claim 4, including:

selecting the hangers with a hollow interior; and routing electrical conductors through hollow interiors of the hangers to the electrical power sockets.

6. A method as set forth in claim 1, wherein:

said step of providing the light elements includes coaxially orienting the lighting elements.

7. A method as set forth in claim 1, wherein:

said fixture support providing step includes providing the fixture supports with downwardly faceing marginal surfaces; and said step of connecting the housing with the fixture supports includes connecting the housing with the downwardly facing marginal surfaces of the fixture supports to create an indirect type of ambient lighting for the associated building.

8. A method as set forth in claim 1, wherein:

said step of providing the fixture supports includes providing the downwardly facing marginal surfaces of the fixture supports with a non-linear profile; and said step of forming the housing includes providing the housing with a nonlinear lateral cross-sectional shape which conforms with the non-linear profile of the fixture support marginal surfaces to further rigidify the lighting fixture.

9. A method as set forth in claim 8, wherein:

said step of forming the housing includes providing the housing with opposite edges which are laterally spaced apart when the housing is connected to the fixture supports to define an upwardly opening window through which light from the lighting elements is emitted from the lighting fixture.

10. A method as set forth in claim 9, further including:

providing a lens; and mounting the lens such that it extends over at least a portion of the window.

11. A method as set forth in claim 10, wherein:

said step of forming the housing includes providing the housing with an upwardly opening, curved trough shape; and said step of providing the fixture supports includes providing the nonlinear, profile of the fixture support marginal surface with a curved shape that mates with the curved trough shape of the housing.

12. A method as set forth in claim 11, wherein:

said step of forming the housing includes providing the housing with down-turned flanges extending along the opposite side edges of the housing;

said step of providing the fixture supports includes providing the fixture supports with downwardly extending notches adjacent upper marginal portions; and said step of connecting the housing to each of the fixture supports includes placing the flanges of the housing into the notches of the fixture supports, thereby connecting the housing with the fixture supports without separate fasteners.

13. A method as set forth in claim 12, wherein:

said step of providing the fixture supports include providing the fixture supports with upwardly facing marginal surfaces within which the notches are disposed.

14. A method as set forth in claim 13, wherein:

said step of providing the fixture supports includes providing the upwardly facing marginal surfaces such that the upwardly facing marginal surfaces are generally flat and horizontally oriented, and providing the notches such that the notches are oriented at an angle to the upwardly facing marginal surfaces to securely capture and retain the flanges therein.

15. A method as set forth in claim 14, wherein:

said step of forming the housing includes providing the housing with an upper surface; and said step of providing the reflector includes forming the reflector contemporaneously with housing such that the reflector overlies the upper surface of the housing.

16. A method as set forth in claim 15, wherein:

said step of providing the fixture supports includes providing the fixture supports with a generally ring-shaped side-elevational shape with an open center and a marginal body.

17. A method as set forth in claim 16, wherein:

said step of providing the power sockets includes providing at least one of the electrical power sockets with a power housing having a ballast mounted therein.

18. A method as set forth in claim 17, wherein:

said step of providing the power sockets includes providing the power housing with a shape that is captured within the open center of an adjacent one of the fixture supports to retain the same without separate fasteners.

19. A method as set forth in claim 18, wherein:

said step of providing the lighting elements includes providing fluorescent tubes.

20. A method as set forth in claim 19, further including:

providing end caps mounted on opposite ends of the lighting fixture.

21. A method as set forth in claim 1, wherein:

said step of providing the fixture supports includes providing fixture supports with a nonlinear profile; and said step of forming the housing includes providing the housing with a nonlinear lateral cross-sectional shape which conforms with the nonlinear profile of said fixture supports to further rigidify the lighting fixture.

22. A method as set forth in claim 1, wherein:

said step of forming the housing includes providing the housing with opposite side edges which are laterally spaced apart when the housing is connected to the fixture supports to define an upwardly opening window through which light from the lighting elements is emitted from the lighting fixture.

23. A method as set forth in claim 1, including:

providing a reflector positioned between the housing and the lighting elements.

24. A method as set forth in claim 1, wherein:

said step of providing hangers includes selecting hangers that have a hollow interior in which electrical conductors are routed to provide electrical power to the lighting elements.

25. A method as set forth in claim 1, wherein:

said step of forming the housing includes providing the housing with an upper surface; and including providing a reflector that overlies the upper surface of the housing and is formed contemporaneously with the housing.

26. A method as set forth in claim 1, wherein:

said step of providing the fixture supports includes providing the fixture supports with a generally ring-shaped side-elevational shape having an open center in which an associated one of said electrical power sockets is received and retained.

27. A method as set forth in claim 1, wherein:

said step of providing the power sockets includes providing at least one of the electrical power sockets with a power housing having a ballast mounted therein.

28. A method as set forth in claim 1, wherein:

said step of providing the lighting elements includes providing fluorescent tubes.

29. A method as set forth in claim 1, wherein:

said step of forming the housing includes forming the housing such that the entire length is about 8 feet.

30. A method as set forth in claim 1, wherein:

said step of forming the housing includes forming the housing such that the entire length is about 12 feet.

31. A method as set forth in claim 1, wherein:

said step of forming the housing on-site at the associated building includes forming the housing in the associated building.

32. A method as set forth in claim 31, wherein the associated building has at least one floor, and wherein said step of forming the housing includes forming the housing on the same floor as the open building plan.

33. A method as set forth in claim 32, wherein:

said step of forming the housing on-site at the associated building includes forming the housing in the open building plan.

* * * * *

UNITED STATES PATENT AND TRADEMARK OFFICE

CERTIFICATE OF CORRECTION

PATENT NO. : 6,305,816 B1
DATED : October 23, 2001
INVENTOR(S) : Corcorran et al.

It is certified that error appears in the above-identified patent and that said Letters Patent is hereby corrected as shown below:

Column 7,
Line 41, “211B” should be -- 21B --.

Column 8,
Line 42, “and” should be -- an --.
Line 49, “connector-s” should be -- connectors --.

Column 9,
Line 28, “faceing” should be -- facing --.
Line 35, “claim 1” should be -- claim 7 --.

Signed and Sealed this

First Day of April, 2003

JAMES E. ROGAN
*Director of the United States Patent and Trademark Office*